US010566008B2

(12) United States Patent
Thorpe

(10) Patent No.: US 10,566,008 B2
(45) Date of Patent: Feb. 18, 2020

(54) METHOD AND APPARATUS FOR ACOUSTIC ECHO SUPPRESSION

(71) Applicant: Cirrus Logic International Semiconductor Ltd., Edinburgh (GB)

(72) Inventor: Peter Thorpe, Cremorne (AU)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 16/185,217

(22) Filed: Nov. 9, 2018

(65) Prior Publication Data

US 2019/0272843 A1 Sep. 5, 2019

Related U.S. Application Data

(60) Provisional application No. 62/637,494, filed on Mar. 2, 2018.

(51) Int. Cl.

| | |
|---|---|
| ***G10L 21/0232*** | (2013.01) |
| ***H04R 1/40*** | (2006.01) |
| ***G10L 25/51*** | (2013.01) |
| ***H04R 3/00*** | (2006.01) |
| ***G10L 21/0208*** | (2013.01) |

(52) U.S. Cl.

CPC ..... *G10L 21/0232* (2013.01); *G10L 21/0208* (2013.01); *G10L 25/51* (2013.01); *H04R 1/406* (2013.01); *H04R 3/005* (2013.01); *G10L 2021/02082* (2013.01); *H04R 2410/07* (2013.01)

(58) Field of Classification Search

CPC . G10L 2021/02082; G10L 2021/02166; G10L 21/0208; G10L 21/0232; G10L 21/0264; G10L 15/20; G10L 15/22; G10L 15/28; G10L 2015/223; H04R 2499/11; H04R 3/005; H04R 1/406; H04R 2201/401; H04R 2201/403; H04R 2203/12; H04R 2430/20; H04R 2430/23; H04R 29/007; H04R 1/403; H04M 9/082; H04M 3/568; G10K 11/178; H04N 7/183

USPC ..... 381/77, 82, 83, 61, 63, 71.8, 94.1–94.8, 381/73.1; 379/406.01–406.08

See application file for complete search history.

(56) References Cited

U.S. PATENT DOCUMENTS

| | | | | |
|---|---|---|---|---|
| 6,246,760 | B1 * | 6/2001 | Makino | H04M 9/082 379/406.08 |
| 7,403,608 | B2 * | 7/2008 | Auvray | H04M 9/082 379/406.01 |
| 8,855,295 | B1 * | 10/2014 | Chhetri | H04M 9/082 379/406.03 |

(Continued)

*Primary Examiner* — Lun-See Lao

(74) *Attorney, Agent, or Firm* — Jackson Walker L.L.P.

(57) ABSTRACT

A method of enhancing an audio signal, the method comprising: receiving a plurality of input audio signals from a plurality of microphones; for each of the plurality of input audio signals, generating at an echo cancellation module, at least one output signal, the at least one output signal comprising one or more of an echo cancelled signal, a post-filter signal and a filter tap signal; analysing the plurality of input audio signals and/or the respective at least one output signal to determine a condition at each of the plurality of microphones; selecting one of the at least one output signals based on the determined condition at each of the plurality of microphones; and generating an echo suppressed audio signal by suppressing echo in an audio signal derived from one or more of the plurality of microphones using the selected one of the at least one output signal.

18 Claims, 5 Drawing Sheets

(56) References Cited

U.S. PATENT DOCUMENTS

| | | | | |
|---|---|---|---|---|
| 9,516,409 | B1 * | 12/2016 | Ramprashad | H04B 3/23 |
| 2003/0105540 | A1 * | 6/2003 | Debail | H04M 9/082 381/66 |
| 2014/0278397 | A1 * | 9/2014 | Chen | G10L 21/02 704/233 |

* cited by examiner

METHOD AND APPARATUS FOR ACOUSTIC ECHO SUPPRESSION

The present disclosure claims priority to U.S. Provisional Patent Application Ser. No. 62/637,494, filed Mar. 2, 2018, which is incorporated by reference herein in its entirety.

TECHNICAL FIELD

The present disclosure relates to methods and apparatus for acoustic echo suppression, particularly in multi-microphone systems.

BACKGROUND

A wide range of audio processing system exist which comprise one or more speakers and more than one microphone. In a typical portable communications device, for example, there may be a loudspeaker, e.g. for media playback, and an earpiece speaker near to where a user's ear may be expected to be in use. The device may also comprise one or more microphones located near where a user's mouth may be expected in use, as well as one or more microphones located in close proximity to the earpiece speaker to aid with noise cancellation and echo suppression. Noise cancelling headsets also comprise multiple speakers and microphones arranged in variety of form-factors, including earbuds, on-ear, over-ear, neckband, pendant, and the like.

In any device comprising a speaker and a microphone in close proximity, suppression of acoustic echo, due to feedback from the speaker to the microphone, is desirable. Conventional echo suppression techniques utilise signals derived from microphone signals to suppress acoustic echo. When microphones become occluded or otherwise affected by external conditions, conventional techniques for echo suppression become less effective.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each of the appended claims.

SUMMARY

According to a first aspect of the disclosure, there is provided a method of enhancing an audio signal, the method comprising: receiving a plurality of input audio signals from a plurality of microphones; for each of the plurality of input audio signals, generating at an echo cancellation module, at least one output signal, the at least one output signal comprising one or more of an echo cancelled signal, a post-filter signal and a filter tap signal; analysing the plurality of input audio signals and/or the respective at least one output signal to determine a condition at each of the plurality of microphones; selecting one of the at least one output signals based on the determined condition at each of the plurality of microphones; and generating an echo suppressed audio signal by suppressing echo in an audio signal derived from one or more of the plurality of microphones using the selected one of the at least one output signal.

The condition may relate to an extent to which the respective microphone is affected by an external condition at the microphone.

Analysing the plurality of input audio signals and/or the at least one output signal may comprise: detecting wind at one or more of the plurality of microphones. The determined condition may relate to an extent to which the respective one or more of the plurality of mics is affected by wind.

Analysing the plurality of input audio signals and/or the at least one output signal may comprise detecting that one or more of the plurality of microphones are blocked based on the plurality of input audio signals and/or the at least one output signal. The determined condition may relate to an extent to which the respective one or more of the plurality of mics is affected by wind.

Detecting that one or more of the plurality of microphones are blocked may comprise extracting one or more common features from each of two or more output signals associated with different ones of the plurality of input audio signals; and comparing the extracted one or more features.

The method may further comprise identifying a difference between a common extracted feature in two or more output signals associated with different ones of the plurality of input audio signals.

The method may further comprise identifying that one of the extracted features is below a threshold value; and determining that the microphone from which the one of the extracted features was derived is blocked based on the identifying.

The one or more extracted features may comprise one or more of the following: a) sub-band noise power; b) sub-band background noise power; c) total signal variation; d) total signal entropy.

The method may further comprise analysing a plurality of echo reference signals, each echo reference signal generated from a signal to be output to a speaker of a plurality of speakers; selecting one of the plurality of echo reference signals based on the analysis of the plurality of echo reference signals, wherein the echo is suppressed in the audio signal using the selected echo reference signal.

Each echo cancelled signal may be generated based on its respective input audio signal and one of the plurality of echo reference signals.

The audio signal may be equal to one of the plurality of input audio signals. Alternatively, the at least one output signal comprises two or more echo cancelled signals and the audio signal may be equal to a blend of two or more of the two or more echo cancelled signals.

The method may further comprise selecting the input audio signal to be echo suppressed based on the analysis of the plurality of input audio signals. The selecting may comprise comparing a signal-to-noise ratio of two or more of the plurality of input audio signals.

The method may further comprise outputting the echo suppressed audio signal.

At least one output signal further comprises one or more of the following: a) one of the plurality of input audio signals; b) a post-filter signal output from an adaptive filter configured to filter a respective one of the plurality of input audio signals; c) a filter tap signal associated with one or more taps of the adaptive filter configured to filter the respective one of the plurality of input audio signals.

According to another aspect of the disclosure, there is provided a computer program comprising instructions which, when executed by a computer cause the computer to carry out the method according to the above.

According to another aspect of the disclosure, there is provided a computer-readable storage medium comprising instructions which, when executed by a computer, cause the computer to carry out the method as described above.

According to another aspect of the disclosure, there is provided an apparatus, comprising: one or more processors configured to: receive a plurality of input audio signals from a plurality of microphones; for each of the plurality of input audio signals, generate at least one output signal, the at least one output signal comprising one or more of an echo cancelled signal, a post-filter signal and a filter tap signal; analyse the plurality of input audio signals and/or the respective at least one output signal to determine a condition at each of the plurality of microphones; select one of the at least one output signals based on the determined condition at each of the plurality of microphones; and generate an echo suppressed audio signal by suppressing echo in an audio signal derived from one or more of the plurality of microphones using the selected one of the at least one output signal.

The condition may relate to an extent to which the respective microphone is affected by an external condition at the microphone, such as a blockage or high noise level due to wind.

Analysing the plurality of input audio signals and/or the at least one output signal may comprise: detecting wind at one or more of the plurality of microphones. The determined condition may relate to an extent to which the respective one or more of the plurality of mics is affected by wind.

Analysing the plurality of input audio signals and/or the at least one output signal may comprise detecting that one or more of the plurality of microphones is blocked based on the plurality of input audio signals and/or the at least one output signal. The determined condition may relate to an extent to which the respective one or more of the plurality of mics is affected by wind.

Detecting that one or more of the plurality of microphones are blocked may comprise: extracting one or more common features from each of two or more output signals associated with different ones of the plurality of input audio signals; and comparing the extracted one or more features.

The one or more processors may be further configured to: identify a difference between a common extracted feature in two or more output signals associated with different ones of the plurality of input audio signals.

The one or more processors are further configured to: identify that one of the extracted features is below a threshold value; and determine that the microphone from which the one of the extracted features was derived is blocked based on the identifying.

The one or more extracted features may comprise one or more of the following: a) sub-band noise power; b) sub-band background noise power; c) total signal variation; d) total signal entropy.

The one or more processors may be further configured to: analyse a plurality of echo reference signals, each echo reference signal generated from a signal to be output to a speaker of a plurality of speakers; select one of the plurality of echo reference signals based on the analysis of the plurality of echo reference signals. The echo may then be suppressed in the audio signal using the selected echo reference signal.

The apparatus may further comprise the plurality of speakers.

Each echo cancelled signal may be generated based on its respective input audio signal and one of the plurality of echo reference signals.

The audio signal may be equal to one of the plurality of input audio signals. Alternatively, the at least one output signal comprises two or more echo cancelled signals and the audio signal may be equal to a blend of two or more of the two or more echo cancelled signals.

The one or more processors may be further configured to: select the audio signal to be echo suppressed based on the analysis of the plurality of input audio signals. The selecting may comprise comparing a signal-to-noise ratio of two or more of the plurality of input audio signals.

The one or more processors may be further configured to: output the echo suppressed audio signal.

At least one output signal further comprises one or more of the following: a) one of the plurality of input audio signals; b) a post-filter signal output from an adaptive filter configured to filter a respective one of the plurality of input audio signals; c) a filter tap signal associated with one or more taps of the adaptive filter configured to filter the respective one of the plurality of input audio signals.

The apparatus may further comprise the plurality of microphones.

According to another aspect of the disclosure, there is provided an electronic device comprising an apparatus as described above. The electronic device is: a mobile phone, for example a smartphone; a media playback device, for example an audio player; or a mobile computing platform, for example a laptop or tablet computer.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

DESCRIPTION OF EMBODIMENTS

Embodiments of the present disclosure relate to methods and apparatus for acoustic echo suppression (AES) in devices having one or more speakers and two or more microphones.

Figure 1:
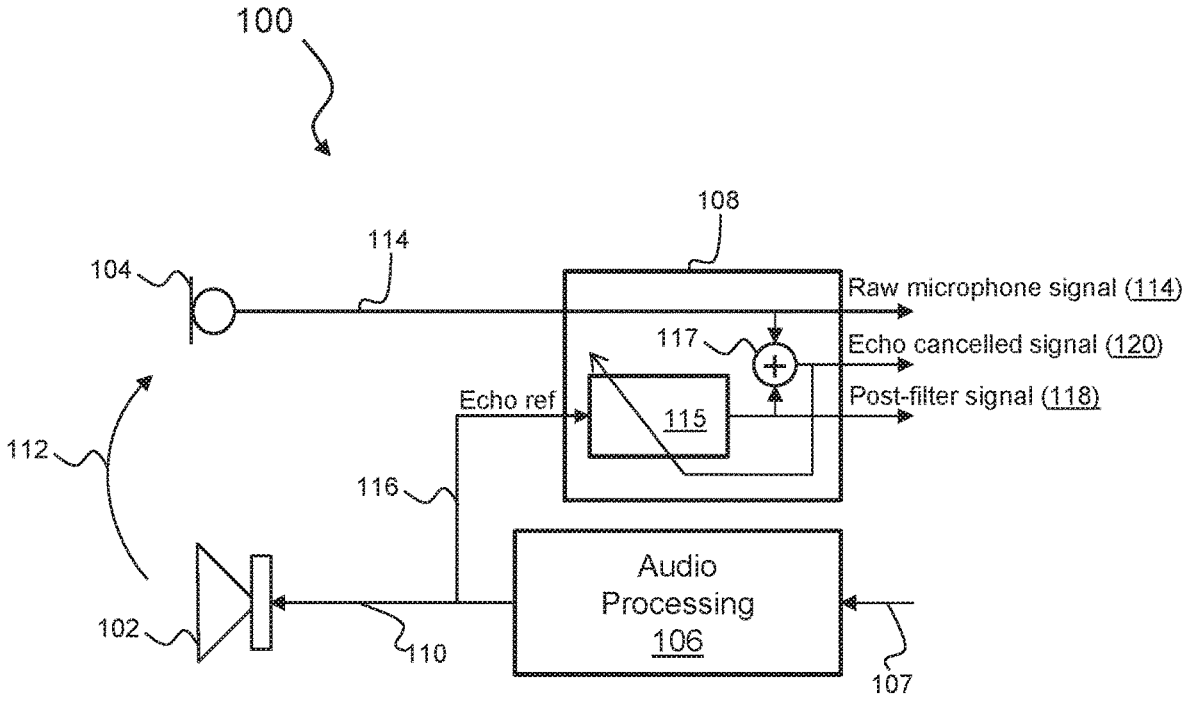
Fig. 1 (prior art)
FIG. 1 is a block diagram of a conventional echo cancellation system known in the art.

A conventional system 100 used to reduce acoustic echo in a received microphone signal is shown in FIG. 1. The system 100 comprises a speaker 102, a microphone 104, an audio processing module 106 and an echo cancelling module 108.

The speaker 102 receives an audio signal 110 via the audio processing module 106 configured to process an input audio signal or signals 107. The speaker 102 generates an acoustic signal, a component of which (a feedback component 112), is received at the microphone 104. The microphone 104 then generates a raw microphone signal 114 which includes the feedback component 112 as well as any other sound picked up by the microphone 104. The raw microphone signal 114 is then provided to the echo cancellation module 108, which also receives an echo reference 116 derived from the audio signal 110 output to the speaker 102. The echo cancellation module 108 typically comprises an adaptive filter 115 and an adder 117. The echo reference signal 116 is filtered by the adaptive filter to generate a post-filter signal 118 which is provided to an input of the adder 117. The raw microphone signal 114 is provided to another input of the adder 117. The adder combines the post-filter signal 118 and the raw microphone signal 114 to generate an echo cancelled signal 120 which is output from the echo cancellation module 108 and also fed back as an input to the adaptive filter 115. In doing so, filter parameters of the adaptive filter 115 are controlled in dependence on the echo cancelled signal 120. In some embodiments, the adaptive filter 115 is a least mean squared (LMS) filter.

The output of echo cancellation systems such as the system 100 above are generally provided to acoustic echo suppression (AES) modules configured to adjust sub-band gain in the echo cancelled signal 120 so that sub-bands containing large amounts of echo are suppressed and sub-bands containing low or no echo are passed through. With reference to the system 100 in FIG. 1, an AES module may receive as inputs the raw microphone signal 114 and the echo cancelled signal 120 and convert those signals into the frequency domain. Respective sub-band levels of the raw microphone signal 114 and echo cancelled signal 120 are then compared to determine a level difference or ratio pre- and post-echo cancellation for each sub-band. As mentioned above, it is desirable to both reduce gain in sub-bands in which echo dominates near-end speech, and maintain gain at or near unity for sub-bands in which near-end speech dominates echo. Accordingly, the AES module may implement a finite impulse response (FIR) filter or the like based on the determined level difference/ratio so as to a) suppress sub-bands in which the presence of echo dominates near-end speech; and b) retain sub-bands in which the presence of near-end speech dominates echo. The FIR filter may then be used to filter the echo cancelled signal 120 to further improve the echo cancelled signal 120. Such AES systems are well documented in the art so will not be described in more detail in this disclosure. However, it will be appreciate that the performance of acoustic echo suppression can be heavily influenced by the quality of the echo cancelled signal 120 generated by the echo cancellation system 100.

In turn, the performance of the echo cancellation system 100 can be heavily influenced by the quality of the signal generated at the microphone 104. In particular, problems arise when ambient noise in the environment or physical blockage of the microphone 104 interferes with the feedback signal 112. A blocked microphone may for example be caused by the user touching or covering the microphone port, or by the ingress of dirt, clothing, hair or the like into the microphone port. A microphone may be blocked only briefly such as when touched by the user, or may be blocked for long periods of time such as when caused by dirt ingress. It follows, therefore, that the performance of acoustic echo suppression can be heavily influenced or degraded by a blocked microphone, since estimates of echo become inaccurate due to the degraded microphone signal.

Embodiments of the present disclosure address the above issues by implementing systems and methods for dynamically selecting microphones for use in acoustic echo suppression. In particular, techniques are provided to dynamically select which of a plurality of microphones should be used to suppress echo in a signal received at one or more microphone. In doing so, signals from underperforming microphones can be identified and signals derived from a different, more suitable microphone selected to be used for acoustic echo suppression.

Figure 2:
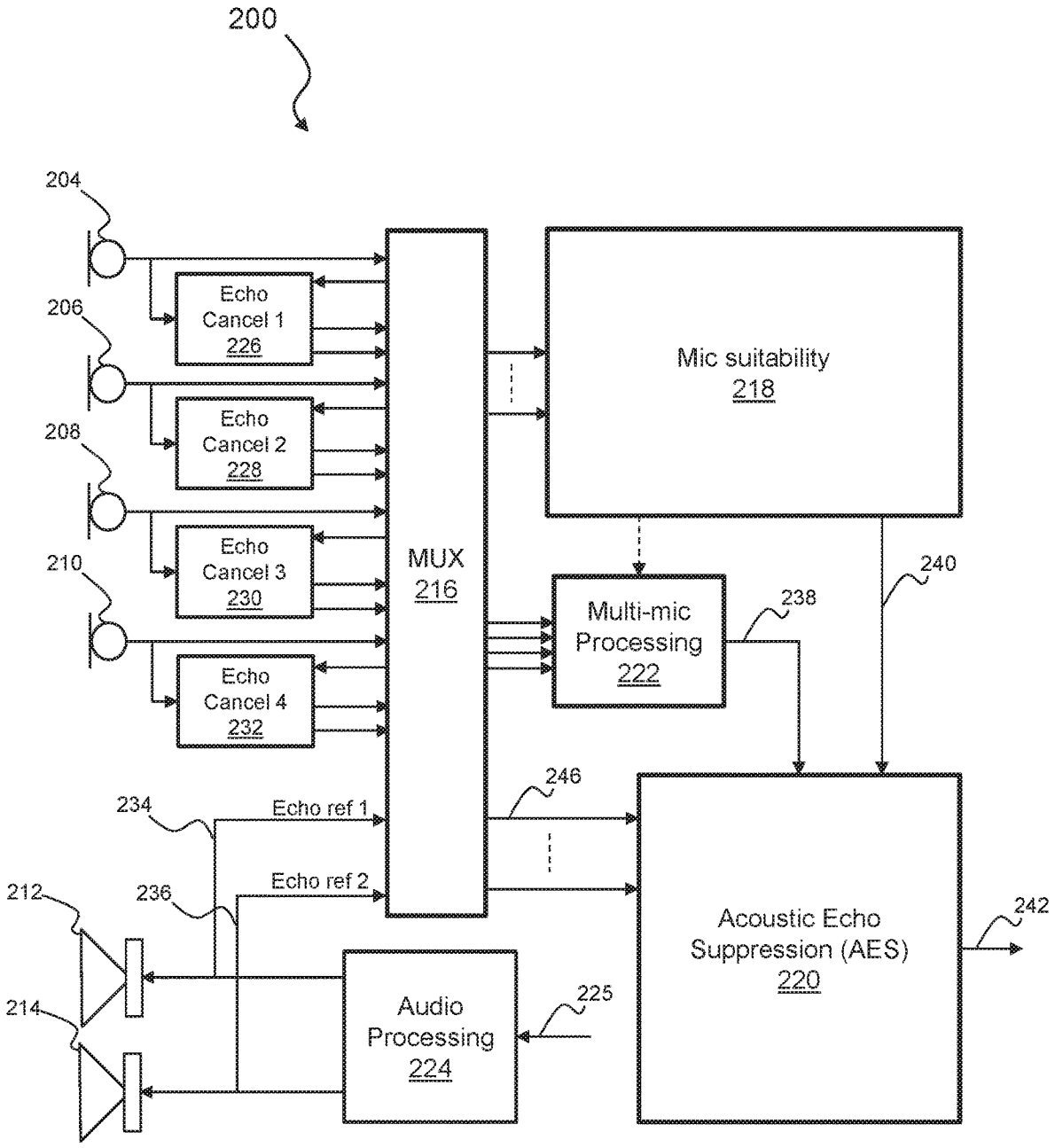
FIG. 2 is a block diagram of a system according to an embodiment of the present disclosure.

FIG. 2 is a block diagram of a system 200 according to embodiments of the present disclosure. Generally, the system 200 is configured to receive a plurality of input audio signals at a plurality of microphones, generate an output microphone signal derived from the plurality of input audio signals, and apply acoustic echo suppression to the output microphone signal in order to remove acoustic echo associated with feedback between one or more speakers and one or more microphones in the system 200.

The system 200 comprises a plurality of microphones 204, 206, 208, 210, a plurality of speakers 212, 214, a multiplexer 216, a microphone suitability module 218, an acoustic echo suppression (AES) module 220, a multi-microphone processing module 222, and an audio processing module 224. The system 200 further comprises a plurality of echo cancellation modules 226, 228, 230, 232, each of which is associated with a respective one of the plurality of microphones 204, 206, 208, 210.

It is noted that the term 'module' shall be used herein to refer to a functional unit or module which may be implemented at least partly by dedicated hardware components such as custom defined circuitry and/or at least partly be implemented by one or more software processors or appropriate code running on a suitable general purpose processor or the like. A module may itself comprise other modules or functional units.

In the embodiment shown in FIG. 2, four microphones 204, 206, 208, 210 are provided. However, it will be appreciated that the present disclosure is not limited to embodiments with four microphones and variations of the system 200 may comprise any number of microphones greater than one. Equally, whilst the system 200 comprises two speakers 212, 214, variations of the system 200 may comprise one speaker or more than two speakers.

The audio processing module 224 is configured receive audio data or information to be output at the first and second speakers 212, 214 and to generate an audio signal to be output to each of the first and second speakers 212, 214. The audio processing module 224 is configured to receive one or more audio signals 225 in any manner known in the art and from any conceivable source. For example, if the system 200 is incorporated into a mobile communications device, the audio processing module 224 may receive the one or more audio signals 225 from a downlink via an RF transceiver, and optionally via other processing modules (not shown). The audio signal or signals 225 received by the audio processing module 224 may additionally or alternatively comprise audio signals suppressed by the system 200.

Audio signals output to the first and second speakers 212, 214 may also be provided as echo reference signals 234, 236 to the multiplexer for distribution to one or both of the microphone suitability module 218 and the multi-microphone processing module 222. Although not shown in FIG. 2, each echo reference signal 234, 236 may also be provided to one or more of the echo cancellation modules 226, 228, 230, 232 as will be described in more detail below.

Figure 3:
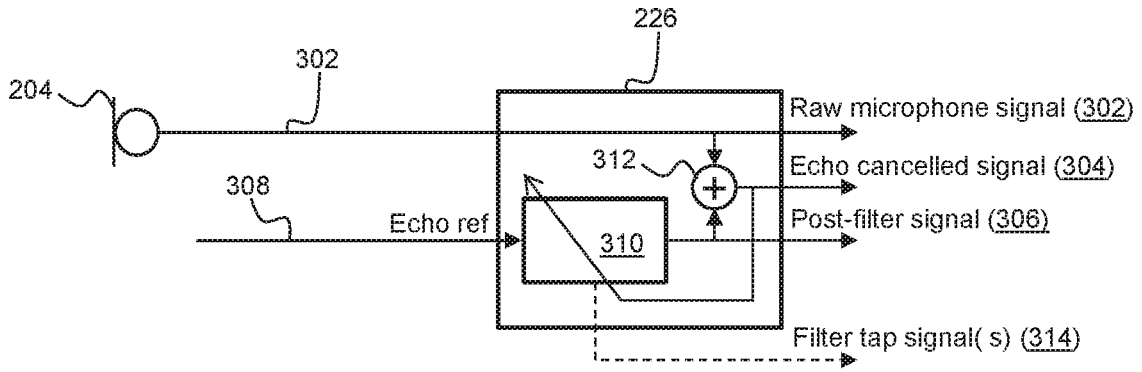
FIG. 3 is a detailed view of one of the microphones and echo cancellation modules of the system shown in FIG. 2.

To describe the interaction between each of the echo cancellation modules 226, 228, 230, 232 and its respective microphone and generally with the multiplexer 216, the first microphone 204 and the first echo cancellation module 226 are shown in greater detail in FIG. 3. It will be appreciated that the second, third and fourth microphones 206, 208, 210 and the second third and fourth echo cancellation modules 228, 230, 232 operate and interact in a similar manner to that of the first microphone 204 and the first echo cancellation module 226, each combination generating a raw microphone signal, an echo cancelled signal and a post-filter signal in a similar manner to that described below. It will also be appreciated that each of the echo cancellation modules 226,228, 230, 232 may be equivalent to the echo cancellation module 108 shown in FIG. 1.

Like the conventional echo cancellation module 108 shown in FIG. 1, the echo cancellation module 226 comprises an adaptive filter 310 and an adder 312 operating in a similar manner to the adaptive filter 115 and adder 117 of the echo cancellation module 108.

Referring to FIG. 3, the first microphone 204 generates a first raw microphone (mic) signal 302 which is provided to the multiplexer 216 as well as the first echo cancellation module 226. Along with the first raw microphone signal 302, the first echo cancellation module 226 also receives an echo reference signal 308. The echo reference signal 308 is derived from an audio signal to be output to a speaker of the system 200. For example, the echo reference signal 308 may be derived from the first echo reference signal 234 or a second echo reference signal 236 to be output to the second speaker 214. A determination on which of the first and second echo reference signals 234, 236 is to be used by the first echo cancellation module 226 may be made based on the physical relationship (such as distance) between the first microphone 204 and each of the speakers 212, 214. The determination may be made based on which of the first and second speakers 212, 214 provides a better feedback signal to the first microphone 204. This determination may be made by taking a measurement of signal strength at each microphone whilst an echo reference signal is being fed to each speaker 212, 214. The association of a particular echo reference signal with a particular microphone may either be predefined or calculated in real-time. Where the first echo reference signal 234 or the second echo reference signal 236 is used as the echo reference signal 308, the echo reference signal 308 may be received either from the first echo reference signal 234 or the second echo reference signal 236 via the multiplexer 216 or via direct links (not shown in FIG. 2).

The first echo cancellation module 226 is configured to generate an echo cancelled signal 304 and a post-filter signal 306 using or based on the first raw microphone signal 302 and the echo reference signal 308, in a manner similar to that described with reference to the echo cancellation module 108 of FIG. 1. The post-filter signal 306 may be an estimate of the echo signal at the first microphone 204 and may be generated in a similar manner to the post-filter signal 118 generated by the echo cancellation module 108 shown in FIG. 1. Filter tap data 314 related to the adaptive filter 310 may be output or accessible by other elements of the system 200 as will be explained in more detail below.

The multiplexer 216 is configured to receive signals from each of the microphones 204, 206, 208, 210 and echo cancellation modules 226, 228, 230, 232 as well as echo reference signals 234, 236 from the audio processing module 224. The multiplexer 216 is further configured to provide one or more of these signals to each of the microphone suitability module 218, the multi-microphone processing module 222 and the AES module 220, and the echo cancellation modules 226, 228, 230, 232.

The multi-microphone processing unit 222 is configured to receive echo cancelled signals from each of the echo cancellation modules 226, 228, 230, 232 and output a processed microphone signal 238 to the AES module 220. In some embodiments, an echo cancelled signal from one of the echo cancellation modules 226, 228, 230, 232 is output as the processed microphone signal 238 unchanged. In other embodiments, the processed microphone signal 238 may be a blended signal comprising components of echo cancelled signals from two or more of the echo cancellation modules 226, 228, 230, 232. In some embodiments, the multi-microphone processing unit 222 may be omitted, the processed microphone signal 238 being received, for example, directly from one of the echo cancellation modules 226, 228, 230, 232 or one of the first, second, third, or fourth microphone 204, 206, 208, 210. It will be appreciated that the choice of which echo cancellation module or modules 226, 228, 230, 232 to use to generate the processed microphone signal 238 may not substantially affect the performance of the acoustic echo suppression module 220.

The microphone suitability module 218 is configured to receive one or more signals from two or more of the microphones 204, 206, 208, 210 and/or two or more of the echo cancellation modules 226, 228, 230, 232. Such signals received by the microphone suitability module 218 may include raw microphone signals (e.g. raw microphone signal 302), echo cancelled signals (e.g. AEC output signal 304), post-filter signals output from one or more adaptive filters comprised in the echo cancellation modules 226, 228, 230, 232 (e.g. AEC post-filter signal 306), and signals/data from adaptive filters comprised in the echo cancellation modules 226, 228, 230, 232 (e.g. filter tap data 314). Such filter tap data may include data relating to a convergence metric in the taps of the one or more adaptive filters (i.e. how fast the taps are changing). The microphone suitability module 218 may then generate a microphone suitability signal 240 containing information as to the suitability of one or more of the microphones 204, 206, 208, 210 for echo suppression. In some embodiments, the microphone suitability signal 240 may comprise suitability information from all of the microphones 204, 206, 208, 210 and corresponding echo cancellation modules 226, 228, 230, 232. In other embodiments, only information pertaining to microphones 204, 206, 208, 210 which are found by the microphone suitability module 218 to be either unsuitable or suitable is transmitted in the microphone suitability signal 240. In embodiments described herein a single microphone suitability signal 240 is generated. In a variation, however, information pertaining to each microphone may be generated and/or transmitted separately.

The microphone suitability signal 240 may be provided to the AES module 220. In doing so, the microphone suitability module 218 may provide the AES module 220 with an indication of the validity of signals derived from each of the microphones 204, 206, 208, 210 and/or whether the conditions at the microphone are such that any signals derived therefrom are suitable (or not) for use in echo suppression.

Figure 4:
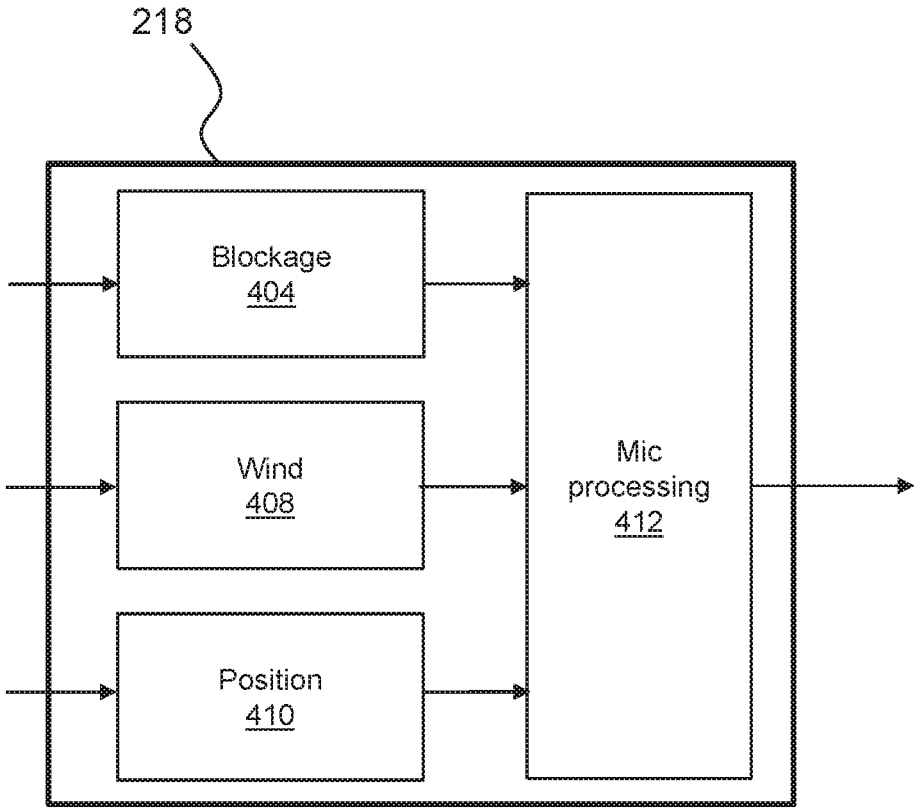
FIG. 4 is a detailed view of the microphone suitability module of the system shown in FIG. 2.

FIG. 4 illustrates the microphone suitability module 218 of some embodiments in more detail. The microphone suitability module 218 may comprise a blockage detection module 404 a wind detection module 408, a position detection module 410, and a microphone processing module 412. It will be appreciated, however, that the microphone suitability module 218 may be modified to include fewer modules or any additional modules for detecting other external conditions or physical impairments of microphones that might affect the condition of signals from one or more of the microphones 204, 206, 208, 210.

In determining the suitability of signals from two or more of the microphones 204, 206, 208, 210, the microphone suitability module 218 may detect a blockage 404 of the microphone or microphone port or wind 408 causing distortion and noise at the microphone. Using one or both of these detected parameters, a microphone processing module 412 may determine a condition at each of the microphones 204, 206, 208, 210 and generate the microphone suitability signal 240 based on the determination. The microphone suitability signal 240 may indicate to the AES module 220 that a particular microphone or its surroundings are such that it or signals derived from it are not suitable for use in echo suppression.

The blockage detection module 404 may determine if a microphone is producing data of reduced quality as a result of a blockage. The blockage detection module 404 may determine that a microphone is blocked by extracting a feature or set of features (e.g. full-band power, sub-band power, entropy etc.) from all of the microphones 204, 206, 208, 210 and comparing the extracted feature or set of features between all other microphones 204, 206, 208, 210 or against a set of threshold values for each feature or set of features. In some embodiments, the blockage detection module may extract features from each of the received raw microphone signals, balance these features across channels during normal operation, compare the features across microphones, and then apply a non-linear mapping to the features. The blockage detection module 404 may then combine the information from the features to decide if a microphone is blocked. For example, a microphone whose feature set is sufficiently different from some or all of the other microphones, or a microphone whose feature set is sufficiently different from the threshold values may be determined as being blocked. If the blockage module 404 determines that a microphone is blocked, the microphone processing module 412 may indicate in the microphone suitability signal 240 that that blocked microphone should not be used. The extracted features may comprise (i) sub-band background noise power in low frequencies (below 500 Hz), (ii) sub-band background noise power in high frequencies (above 4 kHz), (iii) total signal variation, and/or (iv) total signal entropy. Background noise power may be defined as being the signal power present after speech is removed. It is recognised that these are particularly useful signal features to facilitate discrimination between blocked and unblocked microphones. However, alternative embodiments may additionally or alternatively extract other signal features, including but not limited to features such as signal correlation, whether autocorrelation of a single signal or cross correlation of multiple signals, signal coherence, wind metrics and the like.

The wind detection module 408 may detect wind noise in each of the microphones in a manner known in the art. If the wind module 404 determines that a microphone is affected by wind noise, the microphone processing module 412 may indicate in the microphone suitability signal 240 that that wind-affected microphone should not be used.

The position detection module 410 may determine a relative position of two or more of the microphones from the mouth of a user, for example, where the system 200 is part of a multi-microphone headset or the like. The position detection module 410 may be configured to determine which of the microphones is positioned closer to the mouth. For example, where the system 200 is incorporated into a headset having a pendant microphone, the user may tack the pendant microphone behind their ear. In which case, the position detection module 410 may be configured to determine that the quality of the signal received at the pendant microphone has deteriorated due to its placement behind the ear. In another example, where the system 200 is incorporated into a neck-band type of headset, the rotational position of the head relative to the neckband may vary. For example, with the user looking over their left shoulder, a microphone positioned on the left side of the neckband would be positioned far closer to the user's mouth than a microphone positioned on the right side of the neckband.

Similar techniques as those discussed in relation to the blockage module 404 may be used to by the position detection module 410. For example, the position detection module 410 may extract features from each of the received raw microphone signals, balance these features across channels during normal operation, compare the features across microphones, and then apply a non-linear mapping to the features. The position detection module 410 may then combine the information from the features to decide if a microphone is in a non-ideal position. For example, a microphone whose feature set is sufficiently different from a threshold value or significantly different to a typical feature set for that microphone may be in a non-ideal or non-standard position relative to the user. If the position detection module 410 determines that a microphone is in a non-ideal or non-standard position, the microphone processing module 412 may indicate in the microphone suitability signal 240 that should not be used for error suppression. The extracted features may comprise (i) sub-band background noise power in low frequencies (below 500 Hz), (ii) sub-band background noise power in high frequencies (above 4 kHz), (iii) total signal variation, and/or (iv) total signal entropy. Background noise power may be defined as being the signal power present after speech is removed. It is recognised that these are particularly useful signal features to facilitate discrimination between blocked and unblocked microphones. However, alternative embodiments may additionally or alternatively extract other signal features, including but not limited to features such as signal correlation, autocorrelation of a single signal or cross correlation of multiple signals, signal coherence, wind metrics and the like.

In addition to extracting features from microphone channels to determine suitability of microphones for error suppression, the system may utilise one or more accelerometers configured to measure the orientation of a headset and therefore the position of various elements of a headset relative to a user. The measured orientation may then be compared with an expected orientation. A choice of which microphone channel(s) to use for error suppression may be performed based on this comparison.

Referring again to FIG. 2, the AES module 220 may be configured to receive the processed microphone signal 238, signals from each of the first, second, third and fourth echo cancellation modules 226, 228, 230, 232 (via multiplexer 216 and line(s) 246 in FIG. 2) and the microphone suitability signal 240 generated by the microphone suitability module 218.

The AES module 220 may then be configured to generate a suppressed output signal 242 by suppressing the processed microphone signal 238 using an echo cancelled signal derived from one of the first, second, third and fourth echo cancellation modules 226, 228, 230, 232. The suppressed output signal 242 is a version of the processed microphone signal 238 with echo therein suppressed. The AES module 220 may additionally or alternatively be configured to suppress the processed microphone signal 238 using post-filter signals output from one or more adaptive filters comprised in the echo cancellation modules 226, 228, 230, 232 (e.g. AEC post-filter signal 306), and/or signals/data from adaptive filters comprised in the echo cancellation modules 226, 228, 230, 232 (e.g. filter tap data 314).

Using the selected echo cancelled signal, the selected post-filter signal and/or the filter tap data, the AES module 220 may suppress or substantially reduce echo in the processed microphone signal 238. The AES module 220 may, for example, process each of the processed microphone signal 238, a selected echo cancelled signal, a selected post-filter signal, and/or a selected filter tap signal in either the time domain, or the frequency domain, or both. For example, the AES module 220 may convert such signals into the frequency domain, using for example one or more fast Fourier transform (FFT) units (not shown). The AES module 220 may then apply gain to each frequency sub-band of the processed microphone signal 238 based on the frequency domain versions of one or more of the selected echo cancelled signal, the selected post-filter signal, and the selected filter tap data. In some embodiments, respective sub-band levels of the raw microphone signal (received at one of the microphones 204, 206, 208, 210) and echo cancelled signal may be compared to determine a level difference or ratio pre- and post-echo cancellation for each sub-band. As mentioned above, it is desirable to both reduce gain in sub-bands in which echo dominates near-end speech, and maintain gain at or near unity for sub-bands in which near-end speech dominates echo. Accordingly, the AES module 220 may implement a finite impulse response (FIR) filter or the like based on the determined level difference/ratio so as to a) suppress sub-bands in which the presence of echo dominates near-end speech; and b) retain sub-bands in which the presence of near-end speech dominates echo. The FIR filter may then be used to filter the processed microphone signal 238.

The AES module 220 may select which echo cancellation module 226, 228, 230, 232 to use based on the microphone suitability signal 240 received from the microphone suitability module 218. For instance, those microphones indicated in the microphone suitability signal 240 as being blocked, wind affected or otherwise not suitable for echo suppression may be removed from consideration by the AES module 220. The remaining microphones and corresponding echo cancellation modules may then be selected in order of their effectiveness in echo suppression, based on factors such as the strength of voice signal in each microphone during nearfield speech or their position relative to other microphones or speakers in the system. Alternatively, the remaining microphones and corresponding echo cancellation modules may be selected randomly, without any further determination as to the effectiveness of one of those remaining microphones over another.

Figure 5:
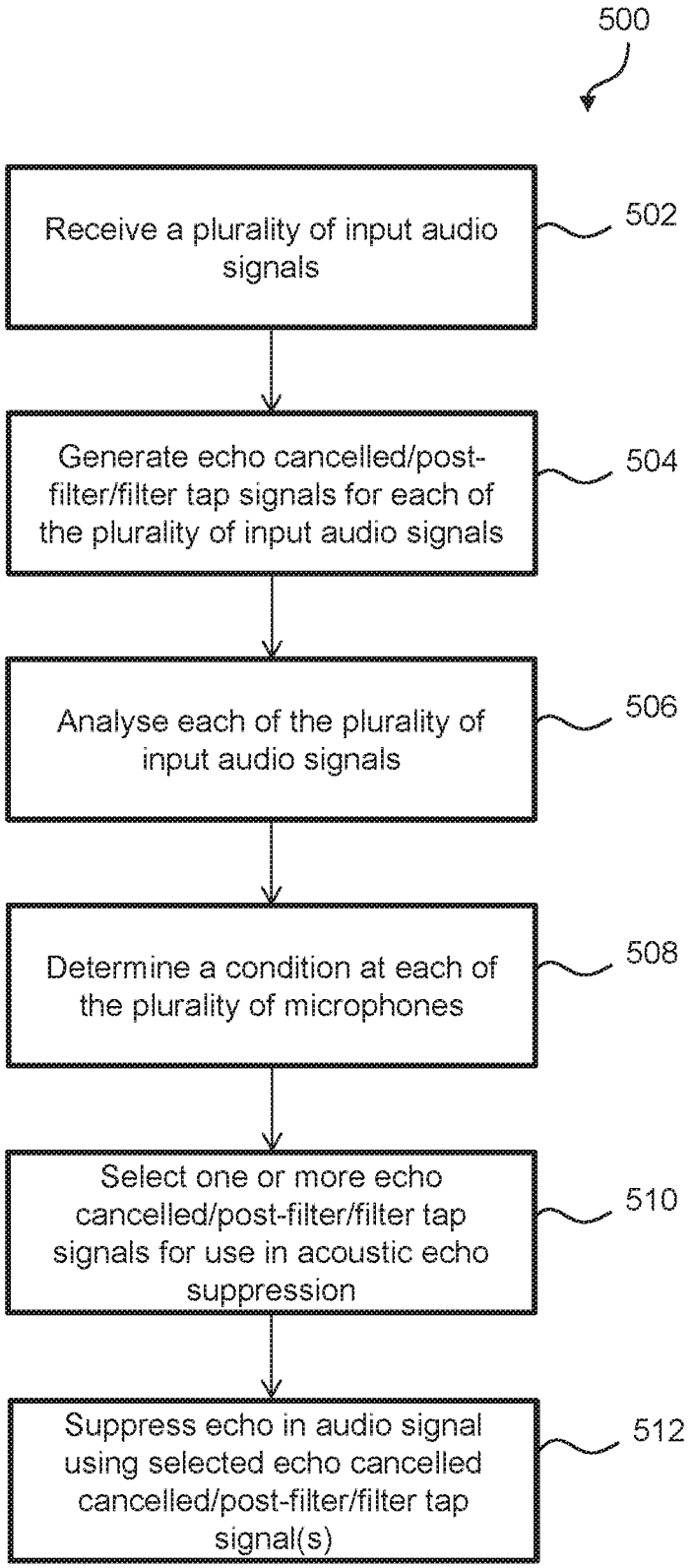
FIG. 5 is a flow diagram of a process performed by the system shown in FIG. 2.

Referring to FIG. 5, a flow diagram for a process 500 performed by the system 200 shown in FIG. 2 will now be described. At step 502, the system receives a plurality of input audio signals at the plurality of microphones 204, 206, 208, 210. At step 504, each of the echo cancellation modules 226, 228, 230, 232 then generates at least one output signal as described above, the at least one output signal comprising one or more of an echo cancelled signal, a post-filter signal and a filter tap signal and outputs that at least one output signal to the multiplexer 216. Each of the input audio signals received at the plurality of microphones 204, 206, 208, 210 are also output, via the multiplexer 216 to the microphone suitability module 218 where they are analysed at step 506. Such analysis may comprise determining a condition, such as an external condition at each microphone, such as a blockage, wind, or position as described above. Based on the analysis performed at step 508, the AES module 220 may select at step 510 which of the at least one output signals, e.g. which echo cancelled signal of the plurality of echo cancelled signals received from the plurality of microphones 204, 206, 208, 210, to be used to suppress echo in an audio signal 238 derived from the input audio signals. Once one or more of the at least one output signal has been selected, the AES module 220 may then suppress echo in the audio signal 238 at step 512, as described above.

Figure 6:
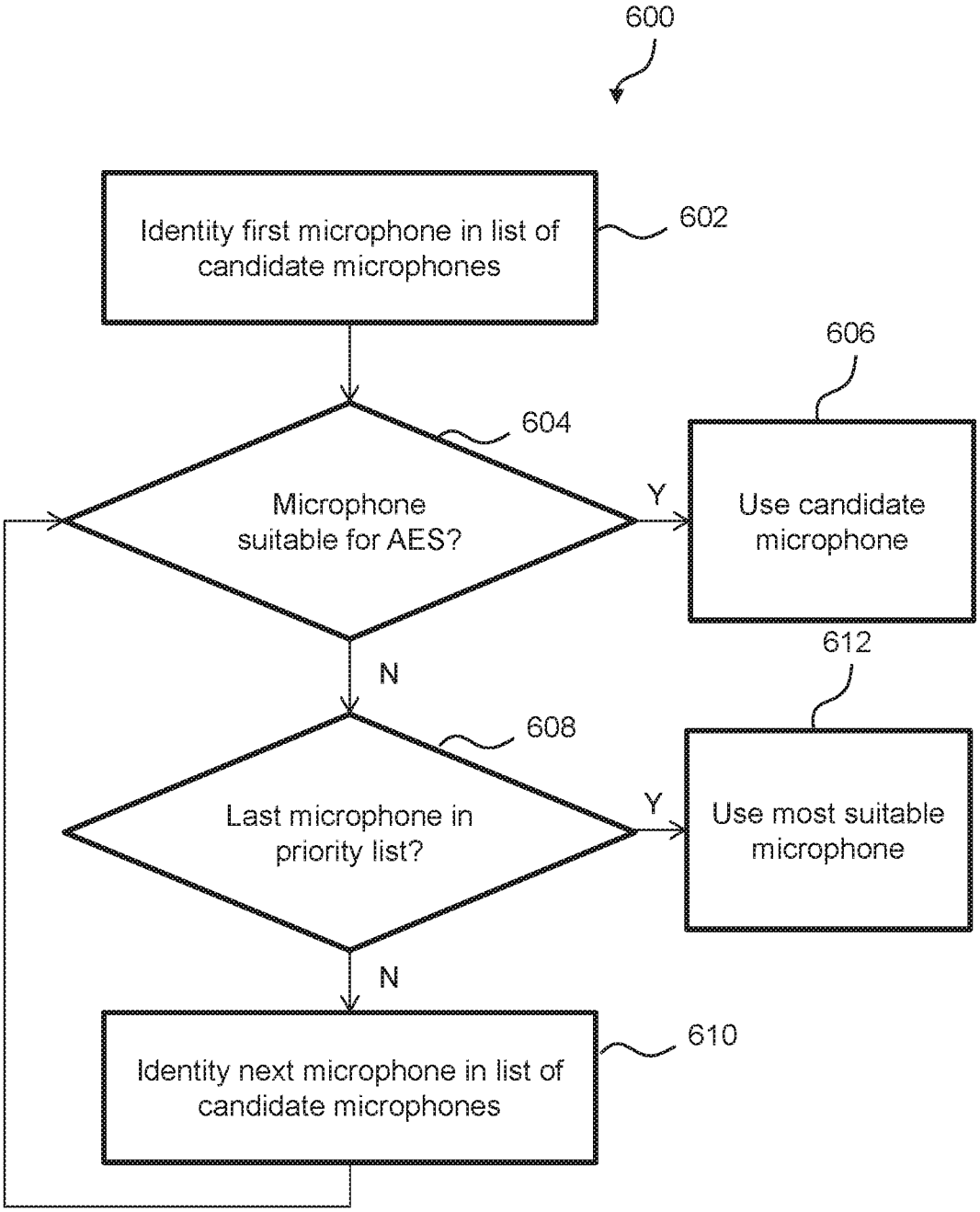
FIG. 6 is a flow diagram of a process performed by the acoustic echo suppression module of the system shown in FIG. 2.

FIG. 6 is a flow diagram showing an example process 600 for selecting which of the four echo cancelled signals to use for echo suppression. In some embodiments, the process 600 may be implemented by one or more processors (not shown) of the system 200 executing code of the AES module 220. At step 602 the AES module 220 may check an initial list of candidate microphones to identify a first candidate microphone. In some embodiments, the initial list of candidate microphones may be an initial priority list of candidate microphones. The microphones may be listed in order of their suitability for use with echo suppression. The list may either be predefined or calculated at runtime. The list order may be determined based on factors such as the strength of voice signals in each microphone during nearfield speech. Alternatively, the initial list of candidate microphones may be unordered.

Starting with the first candidate microphone in the list, the process 600 may then determine at step 604, based on the microphone suitability signal 240 received from the microphone suitability module 218, whether the first candidate microphone is unsuitable, unsatisfactory or in a poor condition for echo suppression. If it is determined at step 604 that the microphone is suitable, i.e. the conditions at the microphone are such that it can be used for echo suppression, then the process 600 may continue to step 606 and the microphone and corresponding echo cancelled signals from that microphone are used to suppress echo in the processed microphone signal 238. If it is determined at step 604 that the conditions at the microphone are not suitable, i.e. the conditions at the microphone are such that it should preferably not be used for echo suppression, then the process 600 may continue to step 608 where the AES module 220 may determine whether the microphone in question is the last microphone in the list of candidates. If it is determined that this is not the case, then the process 600 continues to step 610 where the next microphone in the list of candidates is identified and the process returns to step 604. If it is determined that the microphone in question is the last in the list, then the process continues to step 612 where the most suitable of all of the microphones or the least affected microphone, based on the microphone suitability signal 240, may be selected for echo suppression.

The processed microphone signal 238 may then be enhanced using the selected microphone and the selected echo cancelled signals and/or other signals (i.e. post-filter or filter tap signals).

It will be appreciated that the above process 600 may take place continuously or periodically during operation of the system 200 to ensure that the optimum microphone (and/or associated echo cancelled signals, post-filter signals and/or filter tap signals) are being used to suppress acoustic echo.

In addition to selecting which signals should be used to suppress echo in the processed microphone signal 238, the AES module 220 may also select which echo reference each of the echo cancellation modules 226, 228, 230, 232 use to generate respective echo cancelled signals. As mentioned above, a determination on which echo reference signal 234, 236 is to be used by each echo cancellation module 226, 228, 230, 232 may be made based on the physical relationship (such as distance) between each microphone 204, 206, 208, 210 and each speaker 212, 214. For example, a measurement of signal strength may be taken for each speaker microphone combination whilst an echo reference signal is being fed to one of the speakers 212 followed by the other of the speakers 214. The association of a particular echo reference signal 234, 236 with a particular microphone 204, 206, 208, 210 may either be predefined or calculated in real-time.

The system 200 or any modules thereof may be implemented in firmware and/or software. If implemented in firmware and/or software, the functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and Blu-ray (RTM) discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A method of enhancing an audio signal, the method comprising:

receiving a plurality of input audio signals from a plurality of microphones;

for each of the plurality of input audio signals, generating at an echo cancellation module, at least one output signal, the at least one output signal comprising one or more of an echo cancelled signal, a post-filter signal and a filter tap signal;

detecting an adverse external condition at one or more of the plurality of microphones by analysing the plurality of input audio signals and/or the respective at least one output signal, wherein the adverse external condition is such that a respective input audio signal derived by the respective microphone is unsuitable for use in echo suppression;

selecting a candidate microphone for use in echo suppression, wherein the candidate microphone is a microphone other than the one or more microphones at which the adverse external condition is detected; and generating an echo suppressed audio signal by suppressing echo in an audio signal derived from one or more of the plurality of microphones using an output signal of the at least one output signal derived from the candidate microphone.

2. The method of claim 1, wherein analysing the plurality of input audio signals and/or the at least one output signal comprises:

detecting wind at one or more of the plurality of microphones; and wherein the detected adverse external condition relates to an extent to which the respective one or more of the plurality of microphones is affected by wind.

3. The method of claim 1, wherein analysing the plurality of input audio signals and/or the at least one output signal comprises:

detecting that one or more of the plurality of microphones are blocked based on the plurality of input audio signals and/or the at least one output signal; and wherein the detected adverse external condition relates to an extent to which the respective one or more of the plurality of microphones is blocked.

4. The method of claim 3, wherein detecting that one or more of the plurality of microphones are blocked comprises:

extracting one or more common features from each of two or more output signals associated with different ones of the plurality of input audio signals; and comparing the extracted one or more features.

5. The method of claim 4, further comprising:

identifying a difference between a common extracted feature in two or more output signals associated with different ones of the plurality of input audio signals.

6. The method of claim 4, wherein the one or more extracted features comprises one or more of the following:

a) sub-band noise power;

b) sub-band background noise power;

c) total signal variation;

d) total signal entropy.

7. The method of claim 1, wherein the audio signal is equal to one of the plurality of input audio signals.

8. The method of claim 1, wherein the at least one output signal comprises two or more echo cancelled signals and wherein the audio signal is equal to a blend of two or more of the two or more echo cancelled signals.

9. A non-transitory computer-readable storage medium comprising instructions which, when executed by a computer, cause the computer to carry out the steps of:

receiving a plurality of input audio signals from a plurality of microphones;

for each of the plurality of input audio signals, generating at an echo cancellation module, at least one output signal, the at least one output signal comprising one or more of an echo cancelled signal, a post-filter signal and a filter tap signal;

detecting an adverse external condition at one or more of the plurality of microphones by analysing the plurality of input audio signals and/or the respective at least one output signal, wherein the adverse external condition is such that a respective input audio signal derived by the respective microphone is unsuitable for use in echo suppression;

selecting a candidate microphone for use in echo suppression, wherein the candidate microphone is a microphone other than the one or more microphones at which the adverse external condition is detected; and generating an echo suppressed audio signal by suppressing echo in an audio signal derived from one or more of the plurality of microphones using the at least one output signal derived from the candidate microphone.

10. An apparatus, comprising:

one or more processors configured to:

receive a plurality of input audio signals from a plurality of microphones;

for each of the plurality of input audio signals, generate at least one output signal, the at least one output signal comprising one or more of an echo cancelled signal, a post-filter signal and a filter tap signal;

detect an adverse external condition at one or more of the plurality of microphones by analysing the plurality of input audio signals and/or the respective at least one output signal, wherein the adverse external condition is such that a respective input audio signal derived by the respective microphone is unsuitable for use in echo suppression;

select a candidate microphone for use in echo suppression, wherein the candidate microphone is a microphone other than the one or more microphones at which the adverse external condition is detected; and generate an echo suppressed audio signal by suppressing echo in an audio signal derived from one or more of the plurality of microphones using an output signal of the at least one output signal derived from the candidate microphone.

11. The apparatus of claim 10, wherein analysing the plurality of input audio signals and/or the at least one output signal comprises:

detecting wind at one or more of the plurality of microphones; and wherein the determined condition relates to an extent to which the respective one or more of the plurality of microphones is affected by wind.

12. The apparatus of claim 10, wherein analysing the plurality of input audio and/or the at least one output signal comprises:

detecting that one or more of the plurality of microphones are blocked based on the plurality of input audio signals and/or the at least one output signal; and wherein the detected adverse external condition relates to an extent to which the respective one or more of the plurality of microphones is blocked.

13. The apparatus of claim 12, wherein detecting that one or more of the plurality of microphones are blocked comprises:

extracting one or more common features from each of two or more output signals associated with different ones of the plurality of input audio signals; and comparing the extracted one or more features.

14. The apparatus of claim 13, wherein the one or more extracted features comprises one or more of the following:

a) sub-band noise power;

b) sub-band background noise power;

c) total signal variation;

d) total signal entropy.

15. The apparatus of claim 10, wherein the audio signal is equal to one of the plurality of input audio signals.

16. The apparatus of claim 10, wherein the at least one output signal comprises two or more echo cancelled signals and wherein the audio signal is equal to a blend of two or more of the two or more echo cancelled signals.

17. An electronic device comprising an apparatus according to claim 10.

18. The electronic device of claim 17, wherein the electronic device is: a mobile phone; a smartphone; a media playback device; an audio player; a mobile computing platform; a laptop computer; or a tablet computer.

* * * * *